US007750930B2

(12) United States Patent
Takano et al.

(10) Patent No.: US 7,750,930 B2
(45) Date of Patent: Jul. 6, 2010

(54) PRINTING APPARATUS AND METHOD

(75) Inventors: Hiroaki Takano, Kanagawa (JP); Naoki Takizawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 607 days.

(21) Appl. No.: 11/575,461

(22) PCT Filed: Sep. 16, 2005

(86) PCT No.: PCT/JP2005/017159

§ 371 (c)(1),
(2), (4) Date: Mar. 16, 2007

(87) PCT Pub. No.: WO2006/033302

PCT Pub. Date: Mar. 30, 2006

(65) Prior Publication Data

US 2008/0136891 A1 Jun. 12, 2008

(30) Foreign Application Priority Data

Sep. 21, 2004 (JP) ..... 2004-274238
Sep. 21, 2004 (JP) ..... 2004-274239

(51) Int. Cl.
*B41J 2/00* (2006.01)
*B41J 2/315* (2006.01)
*B41J 2/30* (2006.01)

(52) U.S. Cl. ..... 347/195; 347/194; 347/191; 400/120.15; 400/124.04; 400/120.14; 400/120.09

(58) Field of Classification Search ..... 347/195, 347/194, 191, 174, 192; 400/120.01, 120.09, 400/120.12, 120.14, 124.04, 120.15
See application file for complete search history.

(56) References Cited

U.S. PATENT DOCUMENTS 5,946,020 A * 8/1999 Rogers et al. ..... 347/193

(Continued)

FOREIGN PATENT DOCUMENTS

JP 61277465 A * 12/1986

(Continued)

OTHER PUBLICATIONS

International Search Report dated Dec. 20, 2005.

*Primary Examiner*—Stephen D Meier
*Assistant Examiner*—Rene Garcia, Jr.
(74) *Attorney, Agent, or Firm*—Sonnenschein Nath & Rosenthal LLP

(57) ABSTRACT

A printing apparatus is provided which uses, as a print head, a thermal head having heating elements arrayed in a line perpendicular to the traveling direction of a printing medium. Correspondingly pixel data, at either end, or near the end, of each line of image data going to be printed, data on heat storage in the thermal head (108) is calculated for each line on the basis of data on heat storage in the print head for a preceding line, and the data on heat storage in the print head for each line is compared with predetermined-temperature data. When any of the stored-heat data is larger than the predetermined-temperature data, energy to the heating element (113) is decreased. The image data is printed on the printing medium (104) with the energy for application to the heating element (113) being kept decreased. Thus, even when high-speed printing is done, it is possible to prevent a high temperature from developing at either end of the thermal head, to thereby preventing print-density nonuniformity from resulting in a printed image.

8 Claims, 11 Drawing Sheets

U.S. PATENT DOCUMENTS

| | | | | |
|---|---|---|---|---|
| 6,023,284 | A * | 2/2000 | Rogers et al. | 347/217 |
| 6,108,019 | A * | 8/2000 | Katsuma et al. | 347/188 |
| 6,788,325 | B2 * | 9/2004 | Miller | 347/191 |
| 6,819,347 | B2 * | 11/2004 | Saquib et al. | 347/194 |
| 6,897,887 | B2 * | 5/2005 | Miyajima et al. | 347/195 |
| 7,295,224 | B2 * | 11/2007 | Busch et al. | 347/188 |

FOREIGN PATENT DOCUMENTS

| | | |
|---|---|---|
| JP | 63-047168 | 2/1988 |
| JP | 63-209958 | 8/1988 |
| JP | 63-209872 | 2/1990 |
| JP | 06-008502 | 1/1994 |
| JP | 6-39440 | 5/1994 |
| JP | 11-058808 | 3/1999 |
| JP | 11-179893 | 7/1999 |
| JP | 2000-071505 | 3/2000 |
| JP | 2003-266751 | 9/2003 |
| JP | 2004-136608 | 5/2004 |

* cited by examiner

PRINTING APPARATUS AND METHOD

TECHNICAL FIELD

The present invention relates to a printing apparatus and method, in which a thermal head having heating elements arrayed in a line perpendicular to the traveling direction of a printing medium is used as a print head.

This application claims the priority of the Japanese Patent Application Nos. 2004-274238 and 2004-274239 filed in the Japanese Patent Office on Sep. 21, 2004, the entireties of which are incorporated by reference herein.

BACKGROUND ART

The conventional thermal printers using a thermal head include a sublimation printer, fusion printer, thermal printer, etc. The thermal head used in these printers includes a plurality of heating elements arrayed linearly, energization of each of these heating elements is controlled correspondingly to a gradation level and heat energy thus developed is used to make print on printing media of different types.

The thermal printer will be explained herebelow. In the thermal printer, a printing medium 104 travels being guided by a guide roller 101 and is held tight between a capstan 102 and pinch roller 103, as shown in FIG. 1. Also an ink ribbon cartridge is provided in the thermal printer. It includes a take-up reel 106 and supply reel 107. As the take-up reel 106 is rotated, an ink ribbon 105 wound on the supply reel 107 is taken up by the take-up roll 106. In a printing position where ink in the ink ribbon 105 is to be transferred to the printing medium 104, a thermal head 108 and platen roller 109 are disposed opposite to each other. The ink in the ink ribbon 105 is sublimed by the thermal head 108 and transferred to the printing medium 104.

FIG. 2 gives a detailed illustration of the thermal head 108. As shown, the thermal head 108 includes a ceramic substrate 111, heating elements 113 (will be referred to as "heating element" hereunder) each formed from a heating resistor or the like and disposed linearly on the ceramic substrate 111 with a grace layer 112 laid between them, and a protective layer 114 provided on the heating element 113 to protect the latter. The ceramic substrate 111 is excellent in heat dissipation, and thus functions to prevent the heating element 113 from storing the heat. The grace layer 112 is provided to project the heating element 113 toward the printing medium 104 and ink ribbon 105 in order to putting the heating element 113 into contact with the printing medium 104 and ink ribbon 105. Also the grace layer 112 is a buffer layer to prevent the ceramic substrate 111 from excessively absorbing the heat from the heating element 113. The heating element 113 of the thermal head 108 heats and sublimes the ink in the ink ribbon 105 on the printing medium 104 for transfer to the printing medium 104.

Since the thermal head 108 has a heat capacity and so the heat generated by the heating element 113 is transferred to the printing medium 104 with a delay, the temperature of the heating element 113 itself is higher than the heat required directly for printing. Also, the thermal head 108 is adapted such that its momentary heat value per unit area is further increased and the heat generated by the heating element 113 is controlled to a higher and higher level in order to attain a higher speed of printing.

It should be noted that the resistance of the heating element 113 used in the thermal head 108 changes at a high temperature as will be seen in FIG. 3. As shown, the heating element 113 starts changing in resistance at a temperature T1 and will be broken down when arriving at a temperature T2. For faster printing, the printing medium 104 has to be moved correspondingly faster. Therefore, it is necessary that the heating element 113 should designed to provide a higher temperature. When the temperature becomes higher than the point T1, however, the heating element 113 will change in resistance with a change in heat value thereof, which will cause a print-density nonuniformity.

A technique for overcoming the above-mentioned drawbacks is disclosed in the Unexamined Japanese Patent Publication No. 59359 of 1990. This technique is to solve the aforementioned problem with the use of a combination of a thermistor and zener diode. Also, it is proposed in the Unexampled Japanese Utility Model Publication No. 39440 of 1994 to search a correction data table for correction data on the basis of resistance data and print-density gradation data, correct the energization of each unit heating element on the basis of the correction data and provide a print having a high gradation in density without being influenced by any change in resistance of the heating element. Further, the Unexamined Japanese Patent Publication No. 8502 of 1994 proposes to detect the temperature of a head or print sheet and increase the head or sheet carrying speed in case the detected temperature is higher than a temperature for a predetermined print density.

Incidentally, some of the thermal printers are designed to make margin-less print of image data on the printing medium 104. Such a thermal printer has to be designed to drive the heating element 113 of the thermal head 108 on a track whose width W2 is larger than a width W1 of the printing medium 104 as shown in FIG. 4. Thus, when such margin-less print is to be made, opposite end portions of the thermal head 108 will not be put in contact with the ink ribbon 105 and printing medium 104 as indicated with references 121. The heat of the thermal head 108 are also dissipated via the ceramic substrate 111, ink ribbon 105 and printing medium 104 with which the thermal head 108 is in contact. However, since the non-contact portions 121 are heat-insulated by air layer, it will not be able to dissipate the heat via the ink ribbon 105 and printing medium 104. Therefore, the temperature at the non-contact portions 121 will exceed the temperature T1 and further the temperature T2 as the case may be as shown in FIG. 3. When a dark portion such as a night scene or the like exists around an image, such a temperature is easily elevated because the heating element 113 has to provide a higher temperature. For a higher-speed printing, the heating element 113 has to provide a higher temperature so that the above temperature elevation is more likely to take place.

The sizes of the printing media 104 include various ones including L (89 mm by 127 mm) and KG (106 mm by 156 mm). Many of the ordinary printers are designed to make print on printing media 104 of more than one size. Here will be discussed serial printing including margin-less print on a small-size printing medium 104*a* as shown in FIG. 5A and print on a large-size printing medium 104*b* as shown in FIG. 5B. In this case, the non-contact portions 121 of the thermal head 108 used to make the margin-less print on the small-size printing medium 104*a* will be put in contact with the ink ribbon 105 and printing medium 104 as indicated with references 122. Being the non-contact portions 121 during the preceding print, the contact portions 122 are at a high temperature. So, when print is made on the large-size printing medium 104*b*, the ink in the ink ribbon 105 is sublimed excessively in the non-contact portions 121 alone to result in a high-density ink portion 123 in a printed image, which will cause a print-density nonuniformity. A change of only about 1% in resistance of the heating element 113 will make this print-density nonuniformity visible to the human eyes. Also, when the resistance is decreased, the power and heat value will increase, easily causing a print-density nonuniformity.

Further, the conventional thermal printers can do serial printing. However, such serial printing will cause the thermal head 108 to store the heat. After doing serial printing for a while after initial print, the thermal head 108 will get a higher temperature than that after the initial print. As a result, the density of a printed image will be too high.

To solve the above problem, there has been introduced a technique for decreasing the printing thermal energy which is to be applied to the conventional head 108 when the stored heat is larger. In this technique, consideration is given to the heat storage in the thermal head 108. In the case of a thermal printer, however, the stored heat causes the thermal head 108 to get a temperature approximate to the sublimation point of the ink, the sublimation ink in the ink ribbon 105 will sublime and transfer to the printing medium 104 even if no printing thermal energy is applied to the thermal head 108. It should specially be noted that in case an ink ribbon 105 and printing medium 104, both having a high sensitivity, are used for a higher-speed printing, the sublimation point will possibly be attainable with only the heat stored in the thermal head 108 before it is with the heat from the heating element 113.

The heating element 113 used in the thermal head 108 has such a physical property that the resistance thereof changes at a high temperature, as having previously been described with reference to FIG. 3. As a result, in case serial printing is done, the heating element 113 is continuously driven for a long time, so that the thermal head 108 will store heat. As a result, the heating element 113 will have the resistance thereof changed at a temperature higher than T1, so that the printing thermal energy of the heating element 113 will change, causing a print-density nonuniformity.

The Unexamined Japanese Patent Publication No. 58808 of 1999 discloses a technique for solving the above problem In the Publication, it is proposed to detect the temperature of the thermal head, interrupt energization of the thermal head when it is detected that the thermal head is overheated, and continuously feed the printing sheet with the energization being kept interrupted until the overheat is eliminated, to thereby dissipating the heat from the thermal head. Namely, the technique disclosed in the Publication is such that the overheat causing the print quality to be lower is eliminated by idly feeding the so-called printing medium to efficiently dissipate the heat stored in the thermal head via the printing medium and platen roller.

Therefore, the technique disclosed in the above Unexamined Japanese Patent Publication No. 58808 of 1999 makes it possible to efficiently cool the overheated thermal head and thus resume printing in a reduced wait time. In this case, however, the printing medium has to be reset before resuming the printing operation by reversing the idly forwarded printing medium to a print position where it was at the time of energization interruption. Therefore, even with this proposed technique, it is not possible to reduce the printing time sufficiently.

Especially, when many high-density images such as a night scene are printed at a high speed, the thermal head will have a large heat value, which will lead to frequent stop and cooling of the thermal head as well as to an increased length of time for which the user has to wait. Namely, the conventional thermal printer is not friendly to the user.

DISCLOSURE OF THE INVENTION

It is therefore desirable to overcome the above-mentioned drawbacks of the related art by providing a printing apparatus and method in which even when serial printing is done, it is possible to prevent a high temperature from developing at either end of a thermal head and causing print-density nonuniformity to take place in a printed image.

It is also desirable to provide a printing apparatus and method in which it is possible to prevent a thermal head from being broken down by a high temperature developed at either end of the thermal head and heat stored in the thermal head.

It is also desirable to provide a printing apparatus and method in which it is possible to reduce the total length of printing time by preventing suspension of printing being done.

It is also desirable to provide a printing apparatus and method, capable of providing quality print by preventing print-density nonuniformity from taking place in a printed image due to heat stored in a thermal head.

It is also desirable to provide an information processing apparatus and computer program, that prevent the above-mentioned problems from occurring when the information processing apparatus is being connected to a printer having a thermal head.

According an embodiment of the present invention, there is provided a printing apparatus including:

a printing medium feeding mechanism;

a print head having heating elements arrayed in a line perpendicular to the traveling direction of the printing medium;

a calculator that calculates, correspondingly to pixel data, at either end or near the end, of each line of image data going to be printed, data on heat storage in the print head for a present line on the basis of data on heat storage in the print head for a preceding line;

a comparator that compares the data on heat storage in the print head for each line with predetermined-temperature data; and a controller that reduces energy to be applied by the heating elements to the printing medium when any of the stored heat data is larger than the predetermined-temperature data.

Also, according to another embodiment of the present invention, there is provided a printing apparatus including:

a printing medium feeding mechanism;

a print head having a thermal head in which heating elements are arrayed in a line perpendicular to the traveling direction of the printing medium;

a converter that makes gamma conversion of all or part of image data going to be printed to generate a length of time for which all or part of the heating elements are to be energized;

a prediction unit that generates predicted-temperature data by predicting a temperature of the thermal head after the image data is printed on the basis of heat-value data based on the converter-generated data on the length of time for which all or part of the heating elements are energized;

a comparator that makes comparison between the predicted-temperature data and predetermined-heat data; and a controller that reduces energy to be applied by the thermal head to the printing medium when the predicted-temperature data is larger than the predetermined-temperature data.

Also, according to another embodiment of the present invention, there is provided a printing method for a printing apparatus including a printing medium feeding mechanism and a print head having heating elements arrayed in a line perpendicular to the traveling direction of the printing medium, the method including the steps of:

calculating, correspondingly to pixel data, at either end or near the end, of each line of image data going to be printed, data on heat storage in the print head for a present line on the basis of data on heat storage in the print head for a preceding line;

comparing the data on heat storage in the print head for each line with predetermined-temperature data;

reducing energy to be applied by the heating elements to the printing medium when any of the stored heat data is larger than the predetermined-temperature data; and printing the image data on the printing medium with the energy to the printing medium being reduced.

Also, according to another embodiment of the present invention, there is provided a printing method for a printing apparatus including a printing medium feeding mechanism and a print head having a thermal head in which heating elements are arrayed in a line perpendicular to the traveling direction of the printing medium, the method including the steps of:

making gamma conversion of all or part of image data going to be printed to generate a length of time for which all or part of the heating elements are to be energized;

generating predicted-temperature data by predicting a temperature of the thermal head after the image data is printed on the basis of heat-value data based on the converter-generated data on the length of time for which all or part of the heating elements are energized;

making comparison between the predicted-temperature data and predetermined-heat data; and reducing energy to be applied by the thermal head to the printing medium when the predicted-temperature data is larger than the predetermined-temperature data.

Also, according to another embodiment of the present invention, there is provided an information processing apparatus that outputs image data going to be printed to a printing apparatus including a printing medium feeding mechanism and a print head having heating elements arrayed in a line perpendicular to the traveling direction of the printing medium, the information processing apparatus including:

a calculator that calculates, correspondingly to pixel data, at either end or near the end, of each line of image data going to be printed, data on heat storage in the print head for a present line on the basis of data on heat storage in the print head for a preceding line;

a comparator that compares the data on heat storage in the print head for each line with predetermined-temperature data;

a controller that corrects the image data to reduce energy to be applied by the heating elements to the printing medium when any of the stored heat data is larger than the predetermined-temperature data; and an output unit that outputs the image data corrected by the controller to the printing apparatus.

Also, according to another embodiment of the present invention, there is provided an information processing apparatus that outputs image data going to be printed to a printing apparatus including a printing medium feeding mechanism and a print head having a thermal head in which heating elements are arrayed in a line perpendicular to the traveling direction of the printing medium, the information processing apparatus including:

a converter that makes gamma conversion of all or part of image data going to be printed to generate a length of time for which all or part of the heating elements are to be energized;

a prediction unit that generates predicted-temperature data by predicting a temperature of the thermal head after the image data is printed on the basis of heat-value data based on the converter-generated data on the length of time for which all or part of the heating elements are energized;

a comparator that makes comparison between the predicted-temperature data and predetermined-heat data;

a controller that reduces energy to be applied by the thermal head to the printing medium when the predicted-temperature data is larger than the predetermined-temperature data; and an output unit that outputs the image data corrected by the controller to the printing apparatus.

Also, according to another embodiment of the present invention, there is provided a computer program that can be executed by a computer connected to a printing apparatus including a printing medium feeding mechanism and a print head having heating elements arrayed in a line perpendicular to the traveling direction of the printing medium, the computer program including the steps of:

calculating, correspondingly to pixel data, at either end or near the end, of each line of image data going to be printed, data on heat storage in the print head for a present line on the basis of data on heat storage in the print head for a preceding line;

comparing the data on heat storage in the print head for each line with predetermined-temperature data; and correcting the image data to reduce energy to be applied by the heating elements to the printing medium when any of the stored heat data is larger than the predetermined-temperature data.

Also, according to another embodiment of the present invention, there is provided a computer program that can be executed by a computer connected to a printing apparatus including a printing medium feeding mechanism and a print head having a thermal head in which heating elements are arrayed in a line perpendicular to the traveling direction of the printing medium, the computer program including the steps of:

making gamma conversion of all or part of image data going to be printed to generate a length of time for which all or part of the heating elements are to be energized;

generating predicted-temperature data by predicting a temperature of the thermal head after the image data is printed on the basis of heat-value data based on the converter-generated data on the length of time for which all or part of the heating elements are energized;

making comparison between the predicted-temperature data and predetermined-heat data; and correcting the image data to reduce energy to be applied by the thermal head to the printing medium when the predicted-temperature data is larger than the predetermined-temperature data.

In some of the above embodiments of the present invention, pixel data orthogonal to the traveling direction of the printing medium, that is, pixel data at either end, or near the end, of each line, is extracted from the input image data, a total amount of energy for application to a portion, corresponding to the pixel data, of the print head is pre-calculated, and the print speed and applied energy are controlled based on the result of calculation. Thus, either end of the print head is prevented from partially overheated, which permits to reduce print-density nonuniformity and streak caused by the heat stored in the print head, and margin-less or high-speed printing will result in a high quality of printing.

Also, in the other embodiments, the gamma conversion is made of all or part of image data going to be printed to generate a length of time for which all or part of the heating elements are to be energized, predicted-temperature data is generated by predicting a temperature of the thermal head after the image data is printed on the basis of heat-value data based on the data about the length of time for which all or part of the heating elements are energized, comparison is made between the predicted-temperature data and predetermined-heat data, and energy to be applied by the thermal head to the printing medium is reduced when the predicted-temperature data is larger than the predetermined-temperature data. Therefore, the printing is not suspended by the overheating, so that the total time of printing can be reduced. Also, no print-density nonuniformity occurs in a printed image, which assures an improved quality of printing.

The foregoing and other features, aspects and advantages of the present invention will be come apparent from the following detailed description of preferred embodiments of the present invention when taken in conjunction with the accompanying drawings.

BEST MODE FOR CARRYING OUT THE INVENTION

Figure 1:
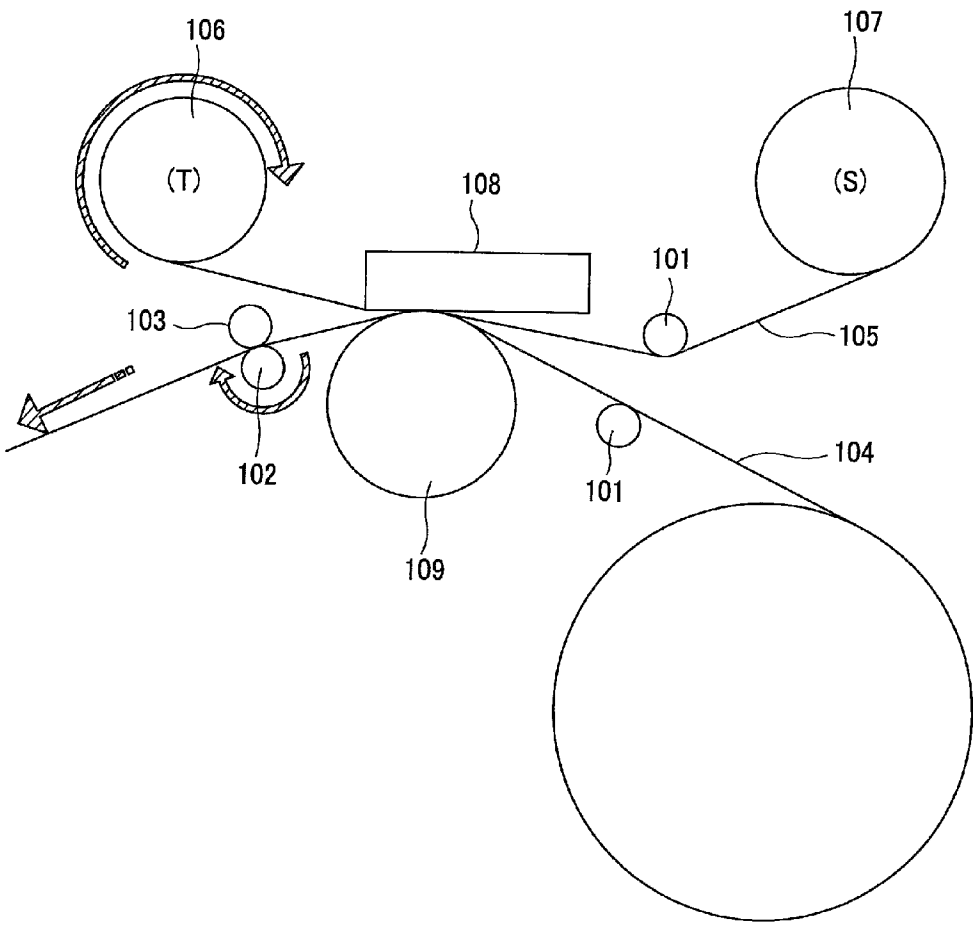
FIG. 1 is a side elevation schematically illustrating the construction of a thermal printer.

The printer as the first embodiment of the present invention will be explained in detail with reference to the accompanying drawings.

The printer (generally indicated with a reference number 1) as the first embodiment is a thermal printer constructed similarly to the thermal printer having previously been described with reference to FIGS. 1 and 2. That is, in the thermal printer 1, a printing medium 104 travels being guided by a guide roller 101 and held tight between a capstan 102 and pinch roller 103. The thermal printer 1 has also provided therein an ink ribbon cartridge including a take-up reel 106 and supply reel 107. As the take-up reel 106 is rotated, an ink ribbon 105 wound on the supply reel 107 is taken up by the take-up roll 106. In a printing position where ink in the ink ribbon 105 is transferred to the printing medium 104, a thermal head 108 and platen roller 109 are disposed opposite to each other. The ink in the ink ribbon 105 is sublimed and transferred by the thermal head 108 to the printing medium 104. In the ink ribbon 105, yellow ink, magenta ink, cyan ink and protective film are provided for one image in series with a film and are sequentially sublimed and transferred by the thermal head to the printing medium 104.

Figure 2:
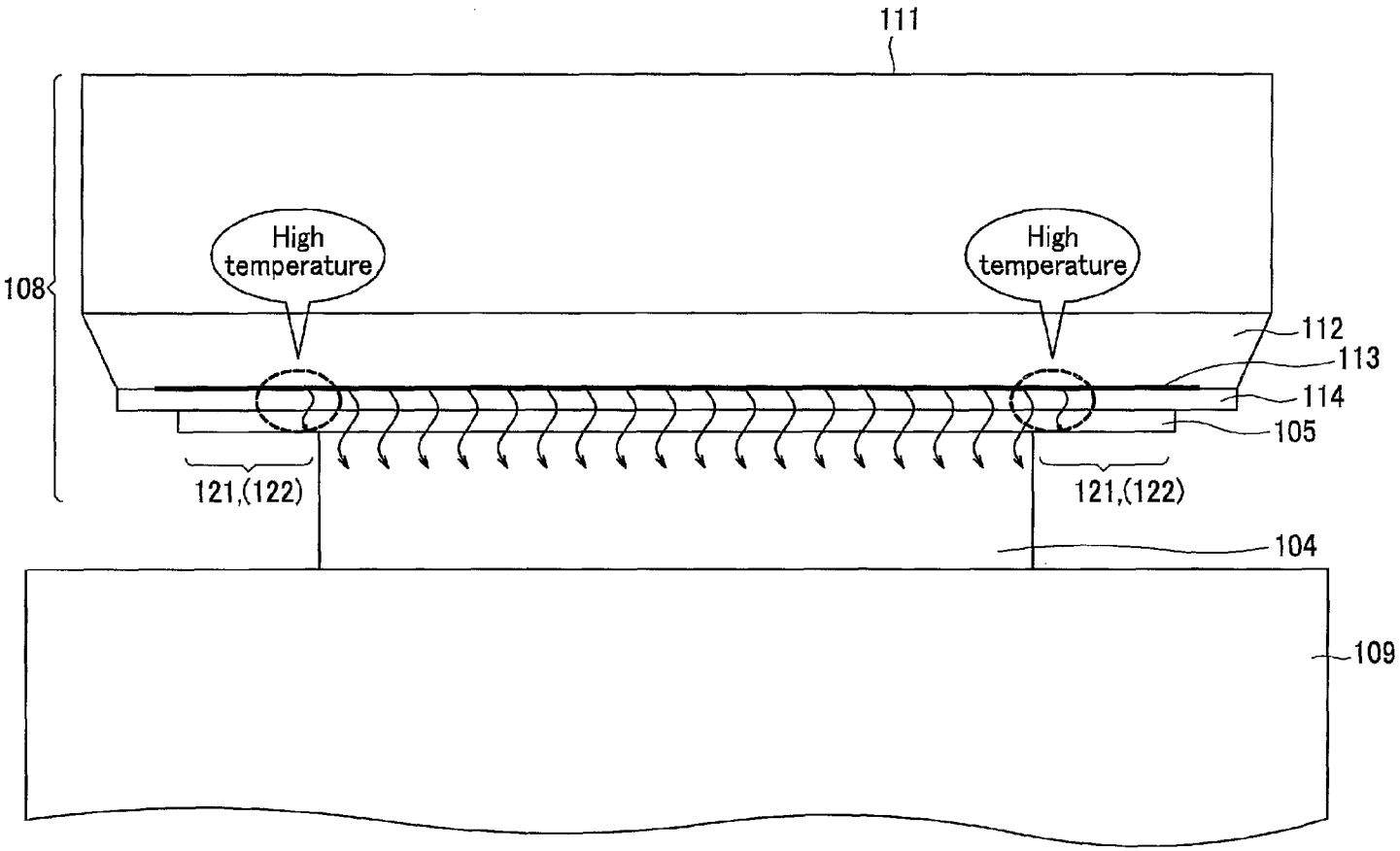
FIG. 2 is a front view of the thermal printer.

As shown in FIG. 2, the thermal head 108 includes a ceramic substrate 111, heating element 113 formed from a heating resistor or the like and disposed linearly on the ceramic substrate 111 with a grace layer 112 laid between them, and a protective layer 114 provided on the heating element 113 to protect the latter. The ceramic substrate 111 is excellent in heat dissipation, and thus functions to prevent the heating element 113 from storing the heat. The grace layer 112 is provided to project the heating element 113 toward the printing medium 104 and ink ribbon 105 to put the heating element 113 into contact with the printing medium 104 and ink ribbon 105. Also the grace layer 112 is a buffer layer to inhibit the ceramic substrate 111 from excessively absorbing the heat from the heating element 113. The heating element 113 of the thermal head 108 heats and sublimes the ink in the ink ribbon 105 on the printing medium 104 for transfer to the printing medium 104. The thermal head 108 is adapted to make print on the printing medium 104 with a marginal space along the periphery of the printing medium 104 and also make margin-less print over the printing medium 104. For margin-less printing, the thermal head 108 is moved in a range somewhat larger than the width of the printing medium 104 in order to accommodate a mechanical precision error. Also, the printer 1 is adapted to print image data on printing mediums 104 of different sizes including L size (89 mm by 127 mm), KG size (106 mm by 156 mm), etc.

Figure 6:
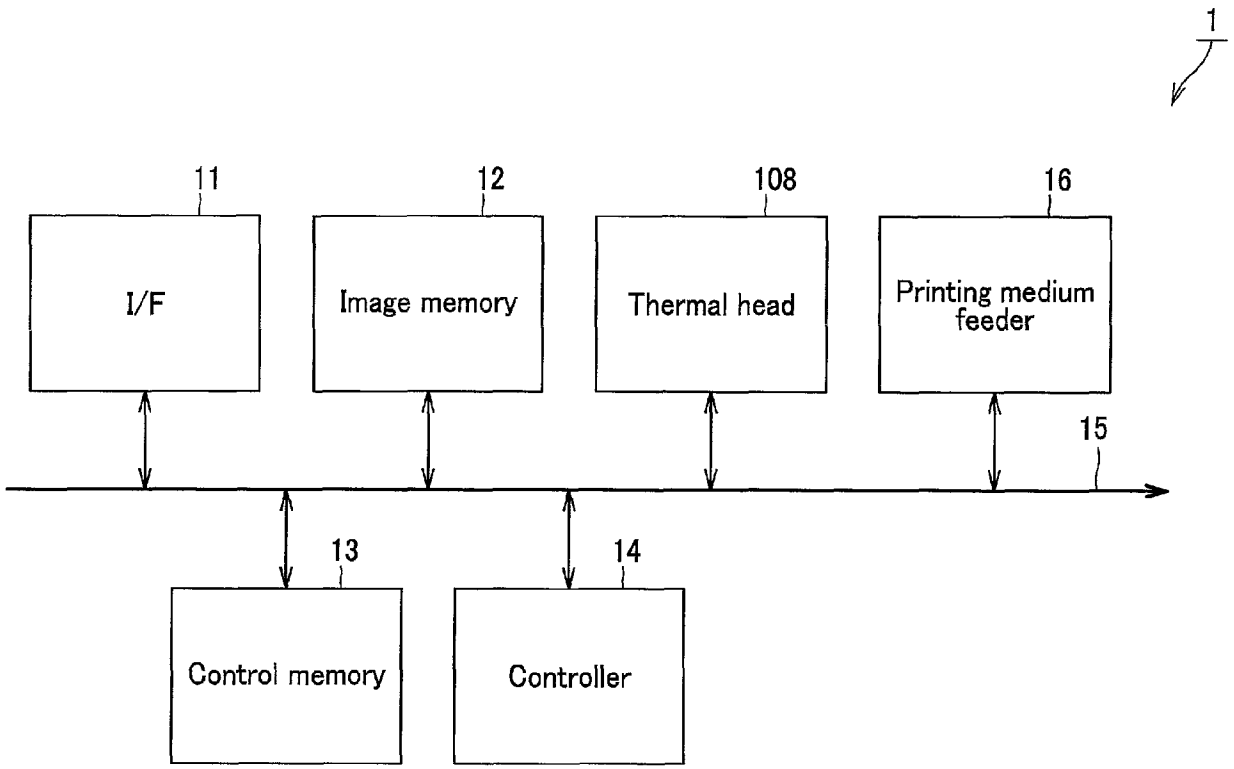
FIG. 6 is a block diagram of a printer as a first embodiment of the present invention.

The circuit configuration of the printer 1 constructed as above will be explained herebelow. As shown in FIG. 6, the printer 1 includes an interface (will be referred to simply as "I/F" hereunder) 11 that is supplied with image data, an image memory 12 that stores the image data supplied from I/F 11, a control memory 13 that stores a control program etc. and a controller 14 that controls the operations of all the components of the printer 1. These printer components are all connected to one another via a bus 15. Also, this bus 15 has connected thereto a printing medium feeder 16 that feeds the printing medium 104 from the supply reel to take-up reel and the thermal head 108.

To I/F 11, there are connected electric devices such as a display device such as LCD (liquid crystal display), CRT (cathode-ray tube) or the like that displays an image to be printed, recording and/or playing device in which a recording medium is installed, etc. For example, when a moving image is being displayed on the display device, still image data selected by the user is supplied to I/F 11. Also, in case I/F 11 has connected thereto a recording and/or playing device, it will be supplied with still image data recorded in a recording medium such as an optical disk, IC card or the like. It should be noted that an electric device is linked to I/F 11 by cable or radio on the basis of USB (Universal Serial Bus) standard, IEEE (Institute of Electrical and Electronic Engineers) 1394 standard or Bluetooth standard.

The image memory 12 has such a capacity as to be able to store at least one image data. It is supplied with image data to be printed from I/F 11 and stores it provisionally. The control memory 13 has stored therein a control program or the like under which all operations of the printer 1 are done. The controller 14 controls the entire printer 1 on the basis of the control program stored in the control memory 13. The controller 14 determines which size of printing medium has been selected by the user, L or KG and controls the printing medium feeder 16 to feed a printing medium 104 of the selected size. Also, when margin-less printing has been selected by the user, the controller 14 will move the thermal head 108 in a range larger than the width of the printing medium 104 the user has selected. Further, the controller 14 calculates data on heat storage in the thermal head 108 or the like on the basis of pixel data at either end of each line of image data stored in the image memory 12, for example, calculates the level of stored heat in the thermal head 108 on the basis of the calculated data and controls the printing medium feeder 16 on the basis of the calculated level of stored heat.

The printing medium feeder 16 includes, for example, a motor to drive the aforementioned capstan 102 which moves the printing medium 104 and a transmission mechanism to transmit the output of the motor to the capstan 102. The printing medium feeder 16 also includes a guide roller 101 to guide the travel of the printing medium 104 and or the like. The motor is controlled by the controller 14 for changing the traveling speed of the printing medium 104 and the like.

Figure 7:
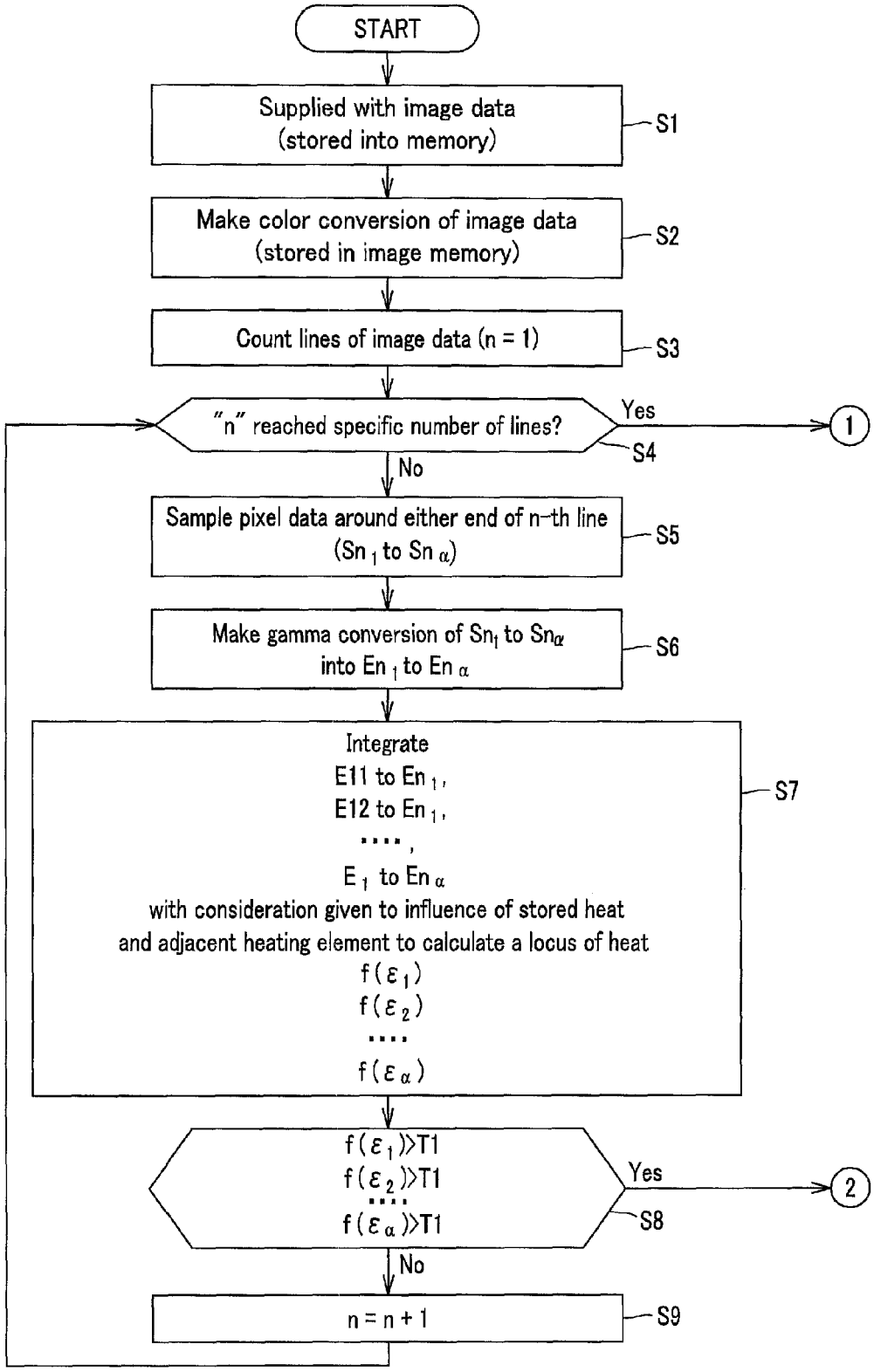
FIG. 7 shows a flow of operations made in the printer as the first embodiment.
Figure 8:
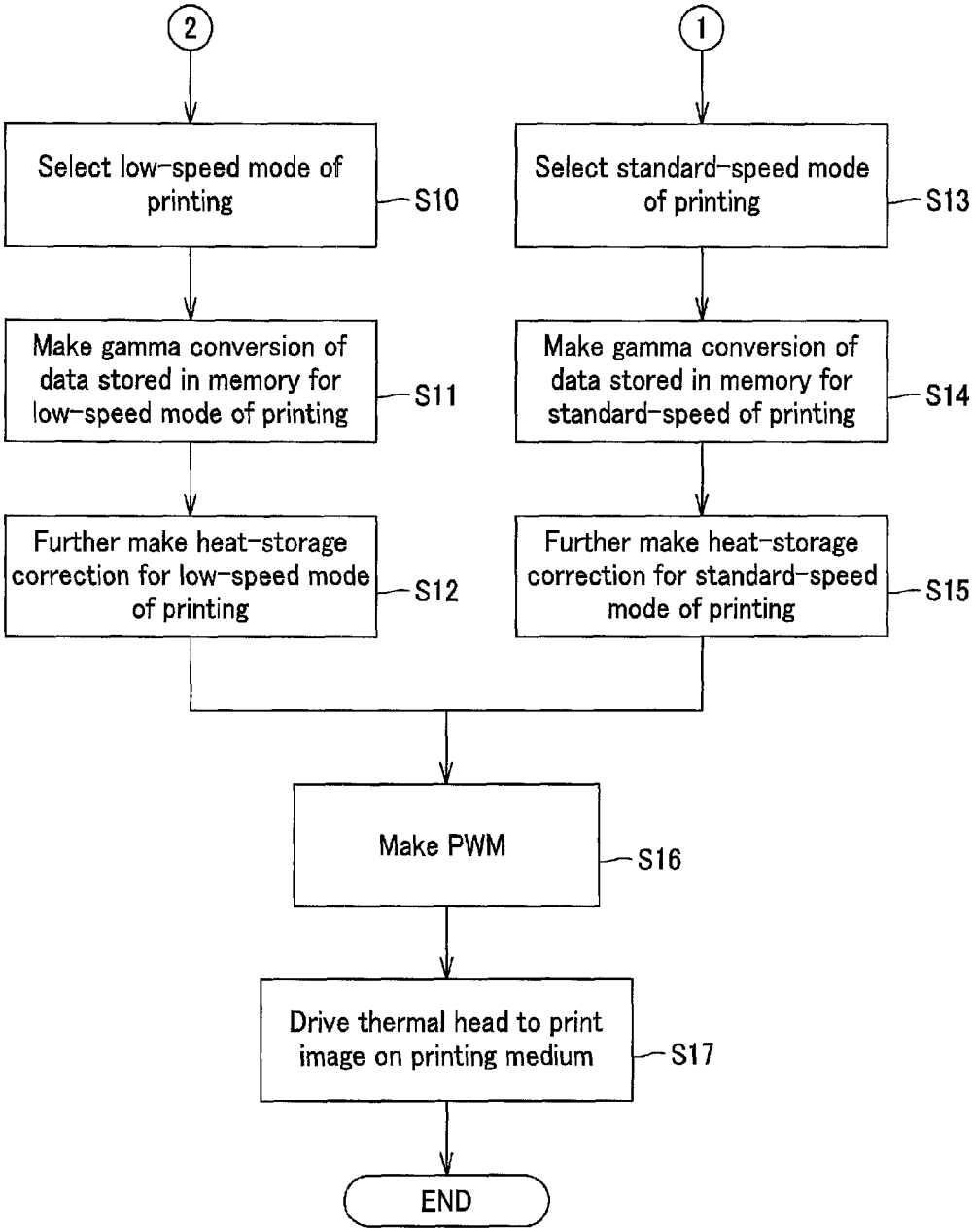
FIG. 8 also shows a flow of operations made following those shown in FIG. 7.

The printer 1 constructed as above operates as will be discussed below with reference to FIGS. 7 and 8.

In step S1, the controller 14 is supplied with image data to be printed from I/F 11 and stores the input image data into the image memory 12. In step S2, the controller 14 makes color conversion of the image data and stores the result into the image memory 12. More specifically, the image data stored in the image memory 12 is developed for the color conversion and converted from data in light's three primary colors R (red), G (green) and B (blue) into gray-scale image data in printing colors C (cyan), M (magenta) and Y (yellow).

In step S3, the controller 11 first sets "n=1" for counting lines of image data to be printed stored in the image memory 12. In step S4, the controller 14 determines whether "n" has reached a specific number of lines. That is, it determines whether all lines of the image data to be printed have been scanned. In case "n" has reached the specific number of lines, the controller 14 will go to step S13. On the contrary, if "n" has not reached it, the controller 14 will go to step S5.

In step S5, the controller 14 extracts pixel data ($Sn_1$ to $Sn_\alpha$) around either end of an n-th line. The range around either end of each line depends upon the mechanical precision error of the printing medium feeder 16. It refers to an area not be likely to contact the printing medium 104. In step S6, the controller 14 makes gamma conversion of the pixel data ($Sn_1$ to $Sn_\alpha$) into a printing power energy for supply to the heating element 113, namely, an energy ($En_1$ to $En_\alpha$) for application to the printing medium 104. The values of energy ($En_1$ to $En_\alpha$) to the printing medium 104 are theoretically or experimentally calculated. The energy is a single-shot one not influenced by the stored heat and adjacent heating element. By repeating steps 4 to 9, the controller 14 also calculates energies ($En_1$ to $En_\alpha$) for application to around either end of each of the second and subsequent lines.

In step S7, the controller 14 makes mainly an integration of E11 to $En_1$, E12 to $En_2$, E13 to $En3_\alpha$, . . . , $E1_\alpha$ to $En_\alpha$ with consideration given to the influence of the stored heat and adjacent heating element to calculate a locus of heat $f(\epsilon_1)$ to $f(\epsilon_\alpha)$. That is, the controller 14 calculates the locus of heat in the thermal head 108 with consideration being given to the influence of stored heat at the time of printing a preceding line. It should be noted that in step S7, consideration may be given to the stored heat during serial printing as well in case a plurality of images is serially printed.

Figure 3:
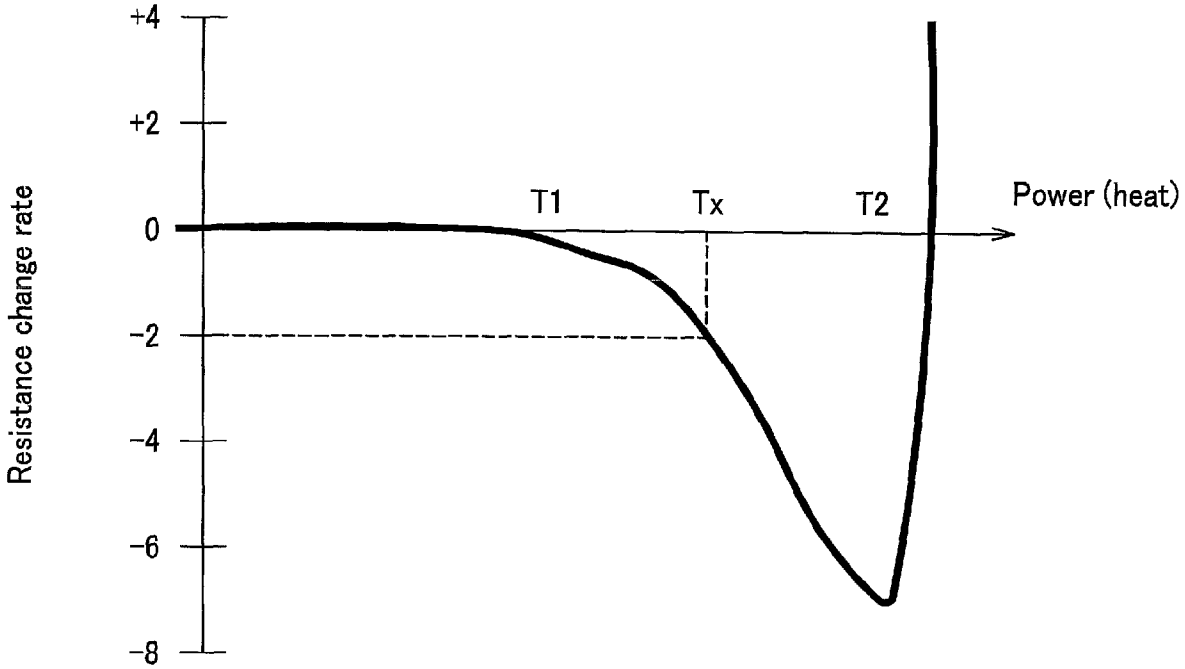
FIG. 3 shows the relation between the temperature and resistance change rate of the heating resistor used in the thermal head.

In step S8, the controller 14 determines whether the locus of heat $f(\epsilon_1)$ to $f(\epsilon_\alpha)$ exceeds the reference point T1 at which the heating element 113 will start being changed in resistance during printing in the course of determining the locus of heat. It should be noted that the reference point T1 is a temperature at which the heating element 113 starts being changed in resistance as shown in FIG. 3 or a temperature a little lower than this temperature. When the locus of heat $f(\epsilon_1)$ to $f(\epsilon_\alpha)$ exceeds the reference point T1 at which the heating element 113 starts being changed in resistance, the controller 14 will go to step S10 where it will make the printing speed slower.

In the above example, pixel data is extracted from around either end of each line. However, pixel data may be extracted from only designated lines, for example, from every several lines, not from all lines, for high-speed printing or because of the printer's performance.

When the controller 14 has calculated a locus of heat $f(\epsilon_1)$ to $f(\epsilon_\alpha)$ of one line in step S9, it will add one (1) to "n" for making heat-locus calculation for a next line and returns to step S4. When it is decided that the locus of heat $f(\epsilon_1)$ to $f(\epsilon_\alpha)$ does not exceeded the reference point T1, that is, when it is decided in step S4 that the loci of heat $f(\epsilon_1)$ to $f(\epsilon_\alpha)$ of all lines do not exceeded the reference point T1, the controller 14 goes to step S13 where it will set a standard feeding of the printing medium 104, higher in speed than in the conventional printer.

It should be noted here that the low-speed mode of printing in step S10 is such that printing is done at a speed approximate to that with the conventional printer, for example and it is exceptionally set in the printer 1 when the temperature of the thermal head 108 becomes higher than T1. On the other hand, a standard-speed mode of printing in step S13 is such that printing is done at a speed higher than with the conventional printer. Namely, in the printer 1 with the thermal head 108, the momentary heat value per unit area has to be higher than the conventional one for higher-speed printing so that the thermal head 108 can easily attain the temperature T1. On this account, the printer 1 is so adapted that with the operations in steps S5 to 9, it is determined before printing whether the stored heat in the thermal head 108 reaches the temperature T1 and that when the stored heat reaches T1, the low-speed mode of printing is to be selected in step S10.

More particularly, when it is decided in step S8 that the stored heat in the thermal head 108 exceeds the reference temperature T1 at which the heating element 113 starts being changed in resistance in the process of calculating the locus of heat $f(\epsilon_1)$ to $f(\epsilon_\alpha)$, the controller 14 selects the low-speed mode of printing in step S10. In step S11, the controller 14 makes, for the low-speed mode of printing, gamma conversion of image data stored in the image memory 12 and going to be printed. Then in step S12, the controller 14 corrects the heat storage for the low-speed mode of printing.

Also, when it is decided in step S4 that the locus of heat $f(\epsilon_1)$ to $f(\epsilon_\alpha)$ for all lines has not exceeded the reference temperature T1, the controller 14 will select the standard-speed mode of printing in step S13, make gamma conversion for the high-speed mode of printing for image data going to be printed, stored in the image memory 12, in step S14, and then correct the heat storage for the high-speed mode of printing in step S15.

In step S16, the controller 14 makes PWM (pulse width modulation) of image data stored in the image memory 12 in step S11 or image data having been subjected the gamma conversion in step S14. Then in step S17, the controller 14 drives the thermal head 108 correspondingly to the image data going to be printed to print an image on the printing medium 104. In case the low-speed mode of printing has been selected in step S10, the controller 14 controls the motor etc. of the printing-medium feeder 16 for low-speed travel of the printing medium 104. For printing at the low speed, the energy to the heating element 113 may be decreased to prevent the thermal head 108 from getting a higher temperature, while the heat stored in the heating element 113 is dissipated from the ceramic substrate 111 and also via the ink ribbon 105 and printing medium 104 to prevent the locus of heat $f(\epsilon_1)$ to $f(\epsilon_\alpha)$ from exceeding the reference point T1. Therefore, the printer 1 can do serial printing at a lower speed without prevention of the serial printing from being ceased. In case the standard-speed mode of printing has been selected in step S13, the controller 14 controls the motor etc. of the printing medium feeder 16 to feed the printing medium 104 at a high speed.

In the printer 1 constructed as above, pixel data orthogonal to the traveling direction of the printing medium 104, that is, pixel data around either end of each line, is extracted from the image data supplied at the I/F 11, a total amount of energy for application to a portion, corresponding to the pixel data, of the thermal head 108, is pre-calculated and the printing speed and applied energy are controlled based on the result of calculation. Therefore, no partial overheating will take place at either end of the thermal head 108. That is, the temperature of the thermal head 108 will not exceed the reference point T1 shown in FIG. 7, so that it is possible to reduce the print-density nonuniformity due to the stored heat and streak. Thus, even margin-less printing or high-speed printing will provide a quality print.

In the foregoing, an example of the printer 1 desired to operate in the standard-speed mode of printing as in step S13 and low-speed mode of printing has been explained. However, according to the present invention, there may be provided a plurality of low-speed modes of printing each corresponding to various levels of temperature and when it is decided that the locus of heat $f(\epsilon_1)$ to $f(\epsilon_\alpha)$ exceeds the reference point T1, the temperature may be controlled more elaborately depending upon the condition of the apparatus. Also in the foregoing, it has been described that when the locus of heat $f(\epsilon_1)$ to $f(\epsilon_\alpha)$ exceeds the reference point T1, the printing medium 104 is moved more slowly. According to the present invention, however, the printer 1 may be adapted such that when the locus of heat $f(\epsilon_1)$ to $f(\epsilon_\alpha)$ exceeds the reference point T1, the thermal head 108 is cooled by a cooling fan or the voltage for application to the heating element 113 is lowered without moving the traveling speed of the printing medium 104 at a lower speed.

Figure 9:
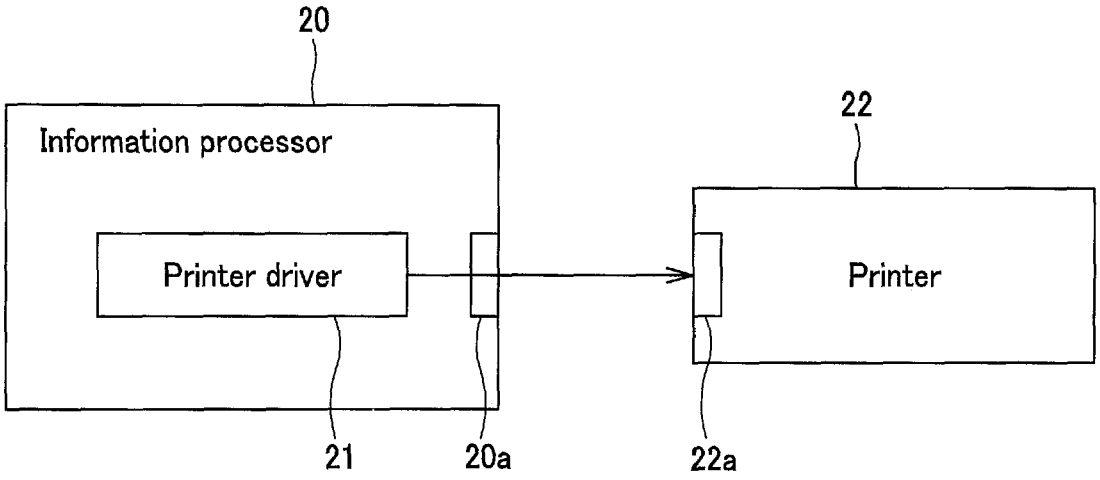
FIG. 9 show a hardware configuration when the computer program as another embodiment of the present invention is applied.

Also, the present invention may be made from a printer driver 21 being software which is to be installed in an information processor 20 such as a personal computer or the like as shown in FIG. 9.

In this case, the printer driver 21 performs the operations in the aforementioned steps S1 to S15 to output processed data to I/F 22*a* of a printer 22 via I/F 20*a* of the information processor 20. The printer 22 has a thermal head 108 as above and makes operations in the aforementioned steps S16 and S17 for data supplied from the information processor 20. The printer driver 21 may be installed in a hard disk drive or the like in the information processor 20 via a recording medium such as an optical disk or the like or a network.

Next, a printer as a second embodiment of the present invention will be explained with reference to the accompanying drawings. The similar elements to those in the first embodiment will be indicated with similar references to those used in the foregoing explanation of the first embodiment and will not be explained any longer. Here will be explained a method of generating, for all image data, a length of time for which all the heating elements are to be energized. A procedure of generating, for a part of the input image data, a length of time for which all the heating elements are to be energized is similar to that shown in FIGS. 7 and 8 except for the necessary of making gamma conversion for standard-speed mode of printing as in the flow diagram in FIG. 11.

The printer 1 as the second embodiment of the present invention is a thermal printer and is constructed similarly to the first embodiment as shown in FIGS. 1 and 2.

Figure 10:
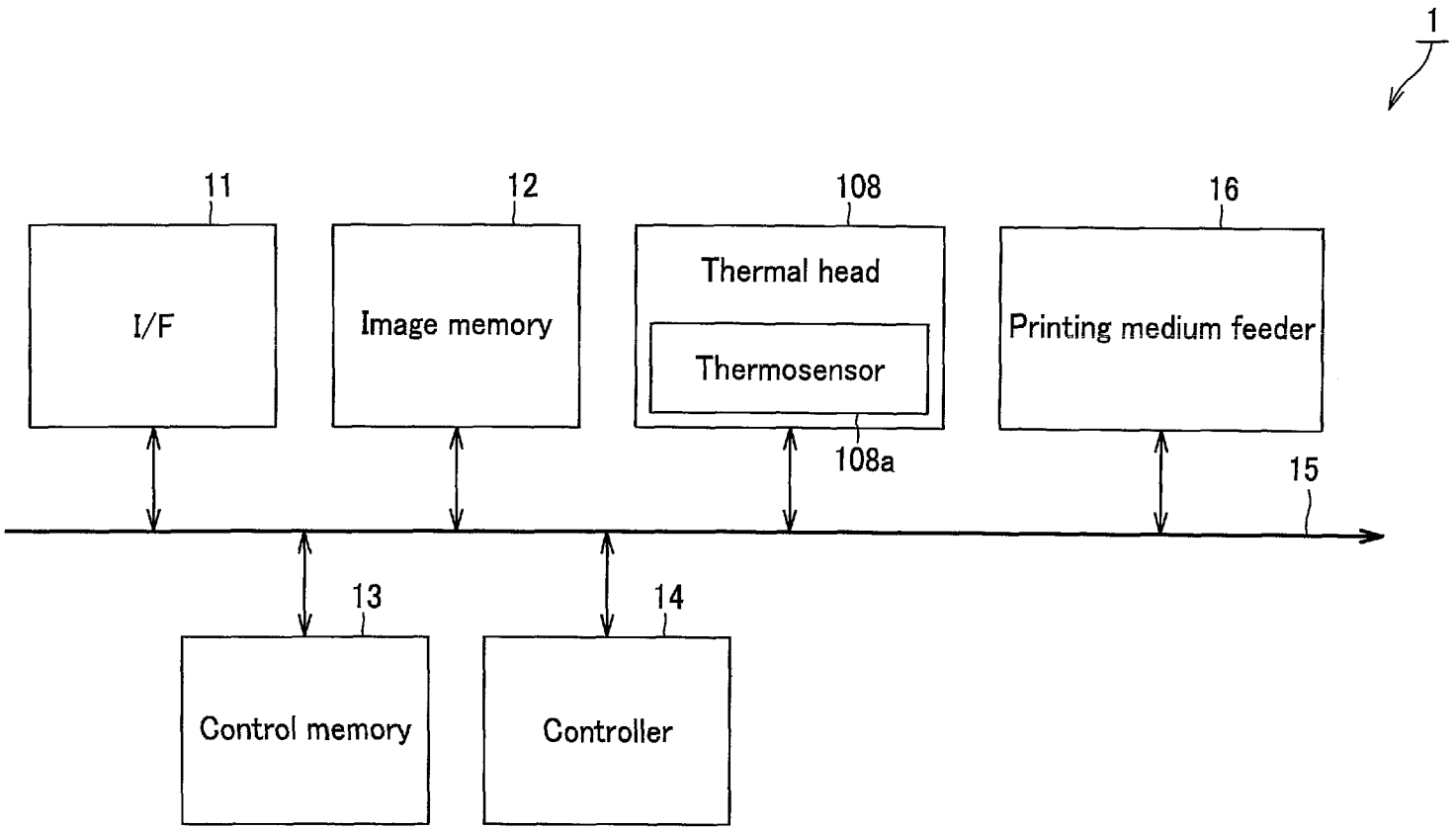
FIG. 10 is a block diagram of a printer as a second embodiment of the present invention.

As will be seen from FIG. 10, the circuit configuration of the printer 1 as the second embodiment is similar to that of the first embodiment shown in FIGS. 1 and 2. The controller 14 generates data on the length of time of energization of the heating element 113 on the basis of pixel data included in image data stored in the image memory 12, for example, generates data on predicted temperature of the heating element 113 that has printed the image data stored in the image memory 12 on the basis of the energization-time data, and controls the heating energy of the heating element 113 and traveling speed of the printing medium 104 on the basis of the predicted-temperature data.

Different from the conventional thermal head 108, the thermal head 108 used in the printer 1 as the second embodiment further includes a thermosensor 108*a* that measures the temperature of, or around, the heating element 113 as shown in FIG. 10. The thermosensor 108*a* detects the temperature of, or around, the heating element 113, that is, the temperature of the thermal head, and outputs present temperature data to the controller 14.

Similar to the first embodiment, the above printer 1 is capable of the standard-speed mode of printing for ordinary printing and the low-speed mode of printing that will exceptionally set when the temperature of the thermal head 108 becomes higher due to the stored heat.

The standard-speed mode of printing is such that printing is done at a high speed as with the conventional printer. The momentary heat value per unit area of the heating element 113 is higher than in the conventional printer and also the traveling speed of the printing medium 104 is set higher than in the conventional printer. On the other hand, the low-speed mode of printing is such that the momentary heat value per unit area of the heating element 113 is smaller than in the standard-speed mode of printing and also the traveling speed of the printing medium 104 is lower than that in the standard-speed mode of printing to dissipate the stored heat in the thermal head 108 more to the printing medium 104 and platen roller 109 as well, to thereby lower the temperature of the thermal head 108. The controller 14 predicts the temperature of the thermal head 108 when the image data stored in the image memory 12 is printed and selects the low-speed mode of printing when the temperature is excessively high.

Figure 11:
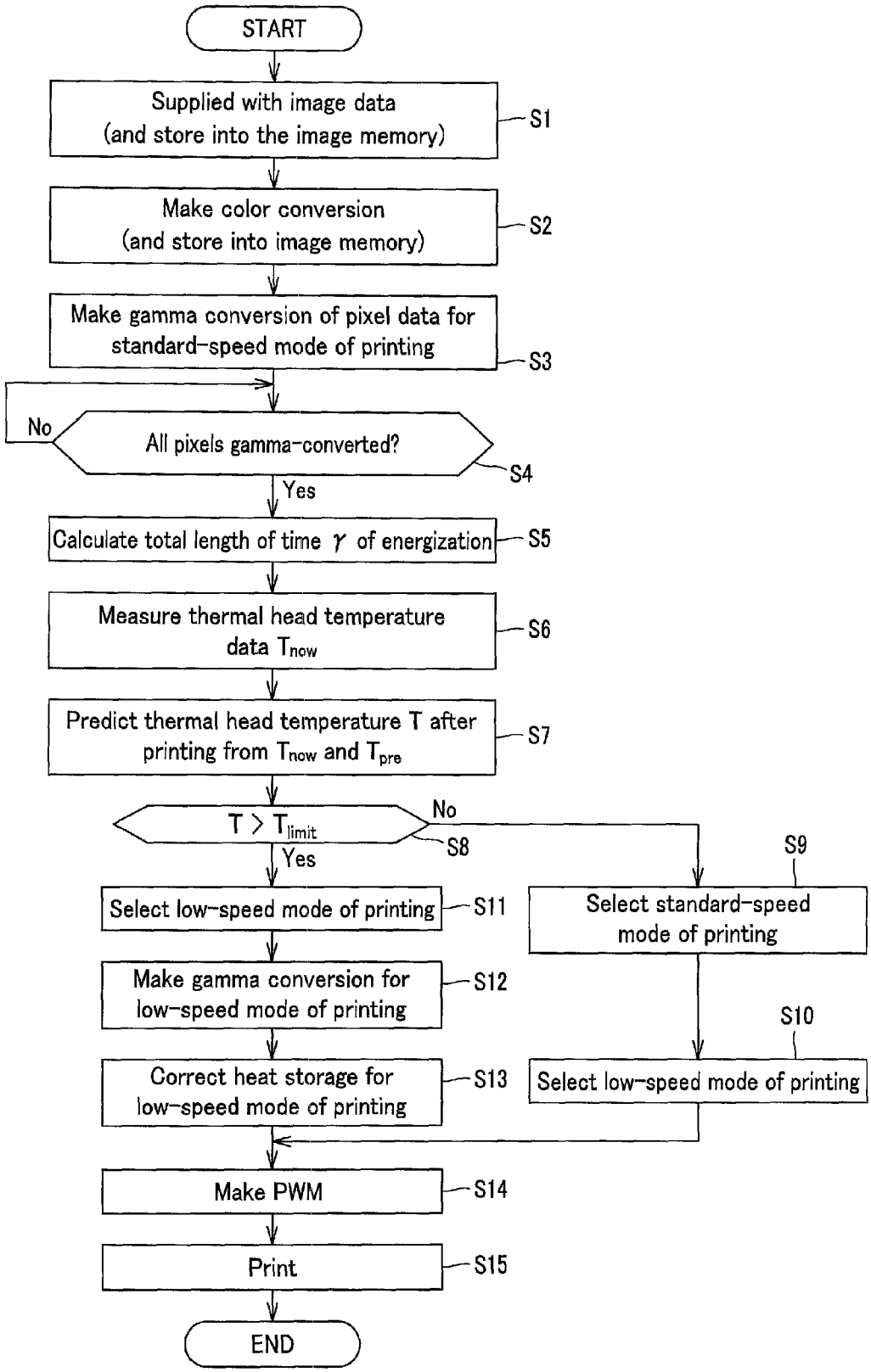
FIG. 11 shows a flow of operations made in the printer as the second embodiment.

More particularly, the controller 14 selects either the standard-speed mode of printing or low-speed mode of printing by following the procedure shown in FIG. 11. That is, in step S21, the controller 14 is supplied with image data to be printed from the I/F 11 and stores the input image data into the image memory 12.

In step S22, the controller 14 makes color conversion of the image data stored in the image memory 12. More specifically, the image data stored in the image memory 12 is developed for the color conversion and converted from data in light's three primary colors R (red), G (green) and B (blue) into gray-scale image data in printing colors C (cyan), M (magenta) and Y (yellow).

In step S23, the controller 14 makes gamma conversion of the pixel data for the standard-speed mode of printing to convert the data into data on a necessary length of time for which the heating element 113 is to be energized, namely, a necessary energy to the printing medium 104. In step S24, the controller 14 determines whether all pixels of the image stored in the image memory 12 have been gamma-converted. In case all the pixels have been gamma-converted, the controller 14 goes to step S25. On the contrary, if all the pixels have not yet been gamma-converted, the controller 14 will repeat the determination in step S24. It should be noted that the gamma conversion may be done with a part of the image data in order to reduce the amount of calculation.

In step S25, the controller 14 calculates a total of application energy, that is, a total length of time Σ for which the heating element 113 is to be energized.

In step S26, the controller 14 acquires temperature of the heating element 113, detected by the thermosensor 108*a* or temperature around the heating element 113, namely, thermal head temperature data Tnow. For example, when serial printing is being done, the temperature data Tnow generated by the thermosensor 108*a* is higher than that when the printer 1 is out of operation because the heating element 113 is still in operation until just before the serial printing. Also, when serial printing is done, the greater the number of prints, the higher the temperature data Tnow is.

In step S27, the controller 14 calculates, based on the total length of time Σ for which the heating element 113 is to be energized, calculated in step S25, a heat value Tpre when the image data stored in the image memory 12 is printed. More specifically, the heat value Tpre thus calculated is a temperature of the heating element 113 or an increment of the temperature around the heating element 113 when the image data stored in the image memory 12 and going to be printed is actually printed. When a high-density image such as night scenes is printed, the heat value Tpre will be larger than when a low-density image is printed. The controller 14 calculates, based on the present temperature data Tnow and calculated heat value Tpre, a temperature of the heating element 113 or predicted temperature T around the heating element 113 when the image data stored in the image memory 12 is printed. The predicted temperature T is a result of addition of the heat value Tpre to the present temperature Tnow. It should be noted that the controller 14 may be adapted to calculate the predicted temperature T with consideration given to the heat dissipation to the printing medium 104, ink ribbon 105, platen roller 109, etc.

In step S28, the controller 14 determines whether the predicted temperature T is higher than a set predetermined temperature $T_{limit}$. It should be noted that the predetermined temperature $T_{limit}$ is a temperature at which the heating element 113 is overheated because its temperature cannot be controlled or a temperature somewhat lower than that temperature. Also, the predetermined temperature $T_{limit}$ is a temperature at which when print is made at a predetermined density onto the printing medium 104, the stored heat in the thermal head 108 will result in an increased temperature of the heating element 113 and the resultant print be excessively dense or a temperature somewhat lower than that temperature. When the predicted temperature T is not higher than the predetermined temperature $T_{limit}$, the controller 14 will go to step S29 where it will maintain the standard-speed mode of printing. When the predicted temperature T is higher than the predetermined temperature $T_{limit}$, the controller 14 will go to step S31 where it will select the low-speed mode of printing.

In the standard-speed mode of printing, the controller 14 corrects the heat storage for the standard-speed mode of printing in step S30. It should be noted that in case a part of the image data has been gamma-converted, the controller 14 will make gamma conversion of all pixels for the standard-speed mode of printing. Also, in the low-speed mode of printing, the controller 14 will make gamma conversion corresponding to the low-speed mode of printing in step S32. More specifically, the controller 14 will make gamma conversion to shorten the length of time for which the heating element 113 is to be energized because the gamma conversion has been made for the standard-speed mode of printing in step S32. Then, the controller 14 makes heat storage correction for the low-speed mode of printing in step S33.

In step S34, the controller 14 makes PWM (pulse width modulation) of the image data gamma-converted in step S23 or S31 and stored in the image memory 12. In step S35, the controller 14 drives the thermal head 108 correspondingly to image data to be printed to print an image onto the printing medium 104. More specifically, in case the controller 14 has selected the standard-speed mode of printing in step S31, it will control the motor etc. of the printing-medium feeder 16 to feed the printing medium 104 at the high speed and make a print at the high speed by increasing the momentary heat value per unit area of the heating element 113. Also, in case the controller 14 has selected the low-speed mode of printing in step S31, it will control the motor etc. of the printing medium feeder 16 to feed the printing medium 104 at the low speed. For low-speed printing, the energy for application from the heating element 113 to the printing medium 104 can be decreased to prevent the thermal head 108 from being hotter. The heat stored in the heating element 113 is dissipated from the ceramic substrate 111 and via the ink ribbon 105, printing medium 104, platen roller 109 and the like as well. In the low-speed mode of printing, the traveling speed of the printing medium 104 is lowered so that the heat value of the heating element 113 can be decreased to reduce the heat storage in the thermal head 108.

In the printer 1 designed as above, a heat value is precalculated from input image data on the basis of a length of time for which an energy is to be applied to the thermal head 108, the traveling speed of the printing medium 104 and heat value of the heating element 113 are controlled based on the calculated heat value to decrease the printing speed in order to promote the heat dissipation from the thermal head 108, whereby printing being done can be prevented from being ceased. Therefore, in this printer 1, the total printing time can be done in a time shorter than that in the conventional printer in which the heat is dissipated from the thermal head 108 by ceasing printing being done.

Also in the printer 1, even in case a high-density image such a night scene is printed by a high-speed or serial printing in which the heat value of the heating element 113 is large, it is possible to prevent the thermal head 108 from getting an excessively high temperature, so that a high-sensitivity ink ribbon 105 and printing medium 104 are usable and also it is possible to prevent print-density nonuniformity or streak from taking place in a printed image.

In the above printer 1, the thermosensor 108*a* is used to measure the present temperature of the heating element 113 or the temperature around the heating element 113. However, the temperature of the heating element 113 or that around the heating element 113 before the image data stored in the image memory 12 is printed may be calculated taking into account the time elapsed from the preceding printing time until the present time, value of the heat dissipated for this elapsed time, calculated based on experiments, etc.

The selection of the standard-speed mode of printing and low-speed mode of printing has been explained in the foregoing. The printing speed may be changed more elaborately on the basis of the predicted temperature T. In this case, the printer 1 is adapted such that when the predicted temperature T is more approximate to the predetermined temperature $T_{limit}$, the printing medium 104 is moved more slowly and the heat value of the heating element 113 is smaller.

Further, the printer 1 may be adapted such that when the predicted temperature T is higher than the predetermined temperature $T_{limit}$, the traveling speed of the printing medium

104 is not decreased to reduce the heat value of the heating element 113 but the thermal head 108 is cooled by a cooling fan or the like to apply a smaller energy to the printing medium 104 or the heating element 113 is applied with a lower voltage.

Figure 4:
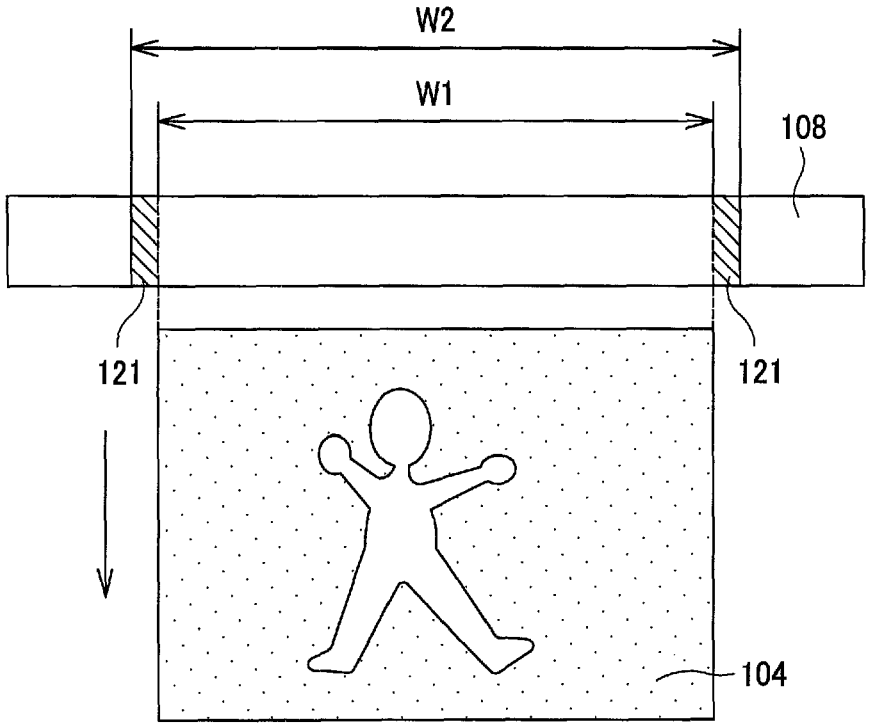
FIG. 4 shows the relation between the printing medium and thermal head when margin-less printing is done.
Figures 5A, 5B:
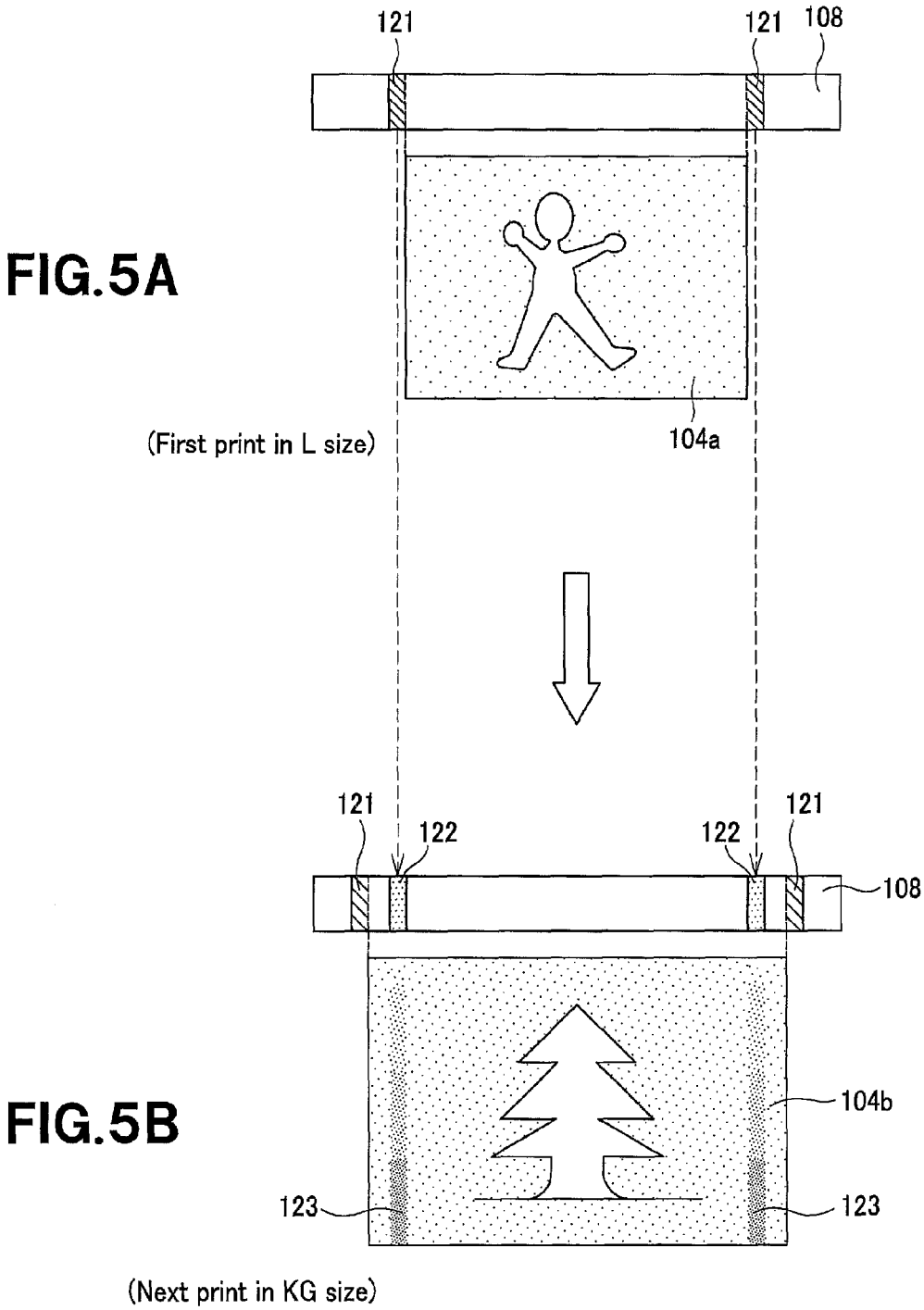
FIGS. 5A and 5B illustrate printing in KG size after printing in L size.

Also, the printer 1 as the second embodiment may be made from the printer driver 21 being software which is to be installed in the information processor 20 such as a personal computer or the like similarly to the printer 1 as the first embodiment as shown in FIG. 4.

In this case, the printer driver 21 performs the operations in the aforementioned steps S21 to S33 except for step S26. The printer 22 has a thermal head 108 and also a thermosensor 108*a* that detects the temperature of the heating element 113 or temperature Tnow around the heating element 113. Since the thermosensor 108*a* is provided in the printer 1, the printer driver 21 acquires the present temperature data Tnow from the printer 22 via I/Fs 20*a* and 22*a* and makes the operation in step S27, namely, calculation of the predicted temperature T. Then the printer driver 21 outputs heat storage data corrected in step S30 or S33 to I/F 22*a* of the printer 22 via I/F 20*a* of the information processor 20. As mentioned above, the printer 22 has the thermal head 108 and processes data supplied from the information processor 20 as in steps S34 and S35. The printer driver 21 may be installed in a hard disk or the like in the information processor 20 via a recording medium such as an optical disk or a network.

The present invention is applicable to the thermal head 108 and further to a line head that is an ink jet printer head having heating elements arrayed in line therein and which produces bubbles in an ink by a resistance heater and jets the ink.

In the foregoing, the present invention has been described in detail concerning certain preferred embodiments thereof as examples with reference to the accompanying drawings. However, it should be understood by those ordinarily skilled in the art that the present invention is not limited to the embodiments but can be modified in various manners, constructed alternatively or embodied in various other forms without departing from the scope and spirit thereof as set forth and defined in the appended claims.

The invention claimed is:

1. A printing apparatus, comprising:

a means for feeding a printing medium;

a print head having heating elements arrayed in a line perpendicular to the traveling direction of the printing medium;

a calculating means that calculates, correspondingly to pixel data, at either end or near the end, of each line of image data going to be printed, data on heat storage in the print head for a present line on the basis of data on heat storage in the print head for a preceding line;

a comparing means for comparing the data on heat storage in the print head for each line with predetermined-temperature data; and a controlling means for reducing energy to be applied by the heating elements to the printing medium when any of the stored heat data is larger than the predetermined-temperature data.

2. The printing apparatus according to claim 1, wherein the calculating means is supplied with pixel data at either end, or near the end, of a designated line and calculates data on heat storage in the print head for a present line on the basis of data on heat storage in the print head for a preceding line.

3. The printing apparatus according to claim 1, wherein the controlling means slows down the traveling speed of the printing medium fed by the printing medium feeding means.

4. The printing apparatus according to claim 1, wherein image data can be printed on printing media of different sizes.

5. The printing apparatus according to claim 1, wherein the print head prints image data over the printing medium.

6. A printing method for a printing apparatus including a means for feeding a printing medium and a print head having heating elements arrayed in a line perpendicular to the traveling direction of the printing medium, the method comprising the steps of:

calculating, correspondingly to pixel data, at either end or near the end, of each line of image data going to be printed, data on heat storage in the print head for a present line on the basis of data on heat storage in the print head for a preceding line;

comparing the data on heat storage in the print head for each line with predetermined-temperature data;

reducing energy to be applied by the heating elements to the printing medium when any of the stored heat data is larger than the predetermined-temperature data; and printing the image data on the printing medium with the energy for application to the printing medium being reduced.

7. An information processing apparatus that outputs image data going to be printed to a printing apparatus including a means for feeding a printing medium and a print head having heating elements arrayed in a line perpendicular to the traveling direction of the printing medium, the information processing apparatus comprising:

a calculating means calculates, correspondingly to pixel data, at either end or near the end, of each line of image data going to be printed, data on heat storage in the print head for a present line on the basis of data on heat storage in the print head for a preceding line;

a comparing means for comparing the data on heat storage in the print head for each line with predetermined-temperature data;

a controlling means for correcting the image data to reduce energy to be applied by the heating elements to the printing medium when any of the stored heat data is larger than the predetermined-temperature data; and an outputting means for outputting the image data corrected by the controlling means to the printing apparatus.

8. A computer program that can be executed by a computer connected to a printing apparatus including a means for feeding a printing medium and a print head having heating elements arrayed in a line perpendicular to the traveling direction of the printing medium, the computer program comprising the steps of:

calculating, correspondingly to pixel data, at either end or near the end, of each line of image data going to be printed, data on heat storage in the print head for a present line on the basis of data on heat storage in the print head for a preceding line;

comparing the data on heat storage in the print head for each line with predetermined-temperature data; and correcting the image data to reduce energy to be applied by the heating elements to the printing medium when any of the stored heat data is larger than the predetermined-temperature data.

* * * * *